US007946207B1

(12) United States Patent
Porter et al.

(10) Patent No.: US 7,946,207 B1
(45) Date of Patent: May 24, 2011

(54) METHODS AND APPARATUS FOR COUNTERING A PROJECTILE

(75) Inventors: James L. Porter, Tucson, AZ (US); Justin C. Jenia, Tucson, AZ (US); Daniel Vukobratovich, Tucson, AZ (US); Byron B. Taylor, Tucson, AZ (US); Daniel R. Melonis, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 271 days.

(21) Appl. No.: 12/138,955

(22) Filed: Jun. 13, 2008

Related U.S. Application Data

(60) Provisional application No. 60/944,072, filed on Jun. 14, 2007.

(51) Int. Cl.
*G01S 13/88* (2006.01)

(52) U.S. Cl. ..... 89/1.11; 342/54

(58) Field of Classification Search ..... 89/1.1, 89/1.11; 342/54, 22; 102/201
See application file for complete search history.

(56) References Cited

U.S. PATENT DOCUMENTS

| | | | | | |
|---|---|---|---|---|---|
| 3,202,934 | A * | 8/1965 | Coffee | 372/80 |
| 3,427,611 | A * | 2/1969 | Enenstein | 342/54 |
| 3,946,233 | A * | 3/1976 | Erben et al. | 250/347 |
| 4,456,912 | A * | 6/1984 | Ensley | 342/13 |
| 5,081,900 | A * | 1/1992 | Buntzen et al. | 89/1.11 |
| 5,198,607 | A * | 3/1993 | Livingston et al. | 89/1.11 |
| 5,600,434 | A * | 2/1997 | Warm et al. | 356/139.08 |
| 5,974,072 | A * | 10/1999 | Hartlove et al. | 372/89 |
| 6,014,922 | A * | 1/2000 | Livingston | 89/1.11 |
| 6,626,396 | B2 | 9/2003 | Secker | |
| 6,825,792 | B1 * | 11/2004 | Letovsky | 342/14 |
| 6,906,659 | B1 * | 6/2005 | Ramstack | 342/54 |
| 7,046,187 | B2 | 5/2006 | Fullerton et al. | |
| 7,202,809 | B1 | 4/2007 | Schade et al. | |
| 7,504,982 | B2 * | 3/2009 | Berg et al. | 342/13 |
| 7,688,247 | B2 * | 3/2010 | Anschel et al. | 342/14 |

* cited by examiner

*Primary Examiner* — Benjamin P Lee
(74) *Attorney, Agent, or Firm* — SoCal IP Law Group LLP; John E. Gunther; Steven C. Sereboff

(57) ABSTRACT

Methods and apparatus for countering a projectile according to various aspects of the present invention may operate in conjunction with a countermeasure system. The countermeasure system may comprise a beam source adapted to generate an electromagnetic beam. The countermeasure system may further include a beam control system adapted to aim the electromagnetic beam at the projectile according to a fire control solution. The beam heats at least a portion of the projectile to a disruption temperature to deflagrate the projectile.

19 Claims, 4 Drawing Sheets

METHODS AND APPARATUS FOR COUNTERING A PROJECTILE

CROSS-REFERENCE TO RELATED APPLICATION

This application claims the benefit of U.S. Provisional Patent Application No. 60/944,072, filed Jun. 14, 2007, and incorporates the disclosure of that application by reference.

BACKGROUND OF INVENTION

Projectiles can be a threat to civilians or military personnel, particularly in areas of conflict. To counter incoming projectiles, some devices and methods use projectiles, such as bullets, that are configured to disrupt the trajectory of the incoming projectile. Problems with countering a projectile with a projectile, however, are numerous and include reloading issues, shrapnel, and the possibility of misfiring.

SUMMARY OF THE INVENTION

Methods and apparatus for countering a projectile according to various aspects of the present invention may operate in conjunction with a countermeasure system. The countermeasure system may comprise a beam source adapted to generate an electromagnetic beam. The countermeasure system may further include a beam control system adapted to aim the electromagnetic beam at the projectile according to a fire control solution. The beam heats at least a portion of the projectile to a disruption temperature to deflagrate the projectile.

BRIEF DESCRIPTION OF THE DRAWINGS

A more complete understanding of the present invention may be derived by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in different order are illustrated in the figures to help to improve understanding of embodiments of the present invention.

DETAILED DESCRIPTION OF EXEMPLARY EMBODIMENTS

The present invention may be described in terms of functional block components and various processing steps. Such functional blocks may be realized by any number of hardware or software components configured to perform the specified functions and achieve the various results. The present invention may employ various elements, materials, systems, sensors, radiation sources, computers, storage systems, power sources, and the like, which may carry out a variety of functions. For example, the countermeasure system may utilize any technique, materials, sensors, etc., for detection and tracking of a threat, such as radar, infrared, radio, audio, etc.

In addition, the present invention may be practiced in conjunction with any number of applications and environments, and the systems described are merely examples of possible applications for the invention.

Figure 1:
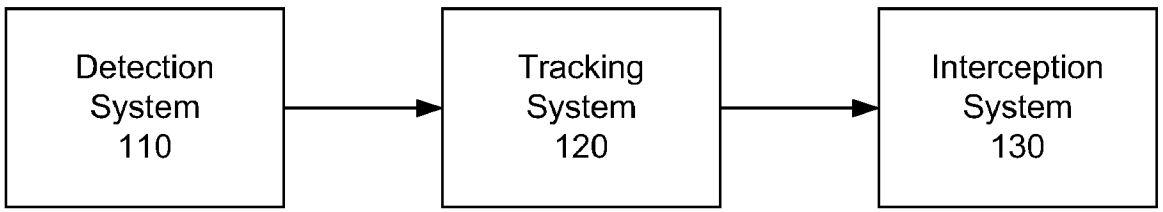
FIG. 1 is a block diagram of a countermeasure system.

Referring now to FIG. 1, a countermeasure system 100 according to various aspects of the present invention comprises a detection system 110, a tracking system 120, and an interception system 130. Generally, the detection system 110 may detect a threat and generate corresponding information for the tracking system 120. The tracking system 120 may establish a track for the threat, which is provided to the interception system 130. The interception system 130 generates an electromagnetic beam to destroy, disable, deflect, or otherwise neutralize the threat. The threat may comprise any item, whether static or in motion, that presents a threat of injury, harm, or damage to any person or property. For instance the projectile could be a grenade, rocket, missile, mortar, bomb, shell, artillery, etc. In the present exemplary embodiment, the projectile comprises a conventional mortar round. The countermeasure system 100 may be adapted to various applications and environments, however, such as close range self-protection, shore defense, airfield defense, green zone defense, shipboard defense, and/or defense against rockets, artillery, mortars, and/or other projectiles.

The detection system 110 detects the projectile. The detection system 110 may comprise any system for detecting the projectile, such as a radar system, infrared sensors, optronic sensors, optical designators, optical detectors, acoustic sensors, or other detection system. The detection system 110 may generate a detection signal corresponding to a position of the projectile and provide the detection signal to the tracking system 120.

In the present embodiment, the detection system 110 comprises an automated fire control system, such as a conventional radar-based close-in weapon fire control system. For example, the detection system 110 may comprise fire control system adapted from the U.S. Army's C-RAM systems, the Swiss 35 mm Skyshield, the Active Protection System developed by the Defense Advanced Research Projects Agency, the Dutch Gaolkeeper system, or other suitable detection system. In the present embodiment, the detection system 110 may comprise the fire control system for a Raytheon Land-Based Phalanx close-in weapon system (CIWS), which utilizes radar to detect a range of the projectile and a separate optical tracker to detect an angle of the projectile. The detection system 110 may detect multiple threats simultaneously, and may generate detection signals relating to the threats, such as position, velocity, angle, ambient temperature, and/or other relevant information. The detection system 110 may detect threats at any appropriate range, such as within at least 400 meters, such as about 1000 meters or more, of the countermeasure system 100.

The tracking system 120 receives the detection signals from the detection system 110 and generates a fire control solution for the interception system 130 in response to the detection signal. For example, the tracking system 120 may receive data from the detection system 110 and compute a fire control solution designed to attack the target. The fire control solution may comprise signals corresponding to a predicted position of the projectile and/or data and/or commands for the interception system 130 to direct the deployment of countermeasures. The tracking system 120 may comprise any system for generating the fire control solution according to the detection signals, such as tracking hardware and software adapted to generate tracks and predicted trajectories for multiple targets. For example, the tracking system 120 may employ appropriate conventional algorithms and filters, such as Kalman filters, condensation algorithms, multiple hypothesis tracking (MHT) algorithms, joint probabilistic data association filters (JPDAFs), or a variation or combination of such algorithms and/or filters.

In the present embodiment, the tracking system 120 comprises the tracking system for the Raytheon Phalanx CMS, which may utilize high energy laser pointing and tracking (HEL-PAT) algorithms and/or AIM-9X/AT-FLIR tracking systems to generate a fire control solution. In the present embodiment, the tracking system 120 may generate fire control solutions for multiple threats simultaneously.

The interception system 130 generates a beam of electromagnetic radiation in response to the fire control solution from the tracking system 120. The interception system 130 counters the threat by intercepting the threat with the beam and controlling the beam's properties. In one embodiment, the interception system 130 controls the beam such that at least a portion of the threat is heated to a disruption temperature. The disruption temperature is a temperature at which the threat begins to deflagrate. For example, the deflagration temperature of a conventional mortar round is reached at about 300 degrees Celsius or below.

Figure 2:
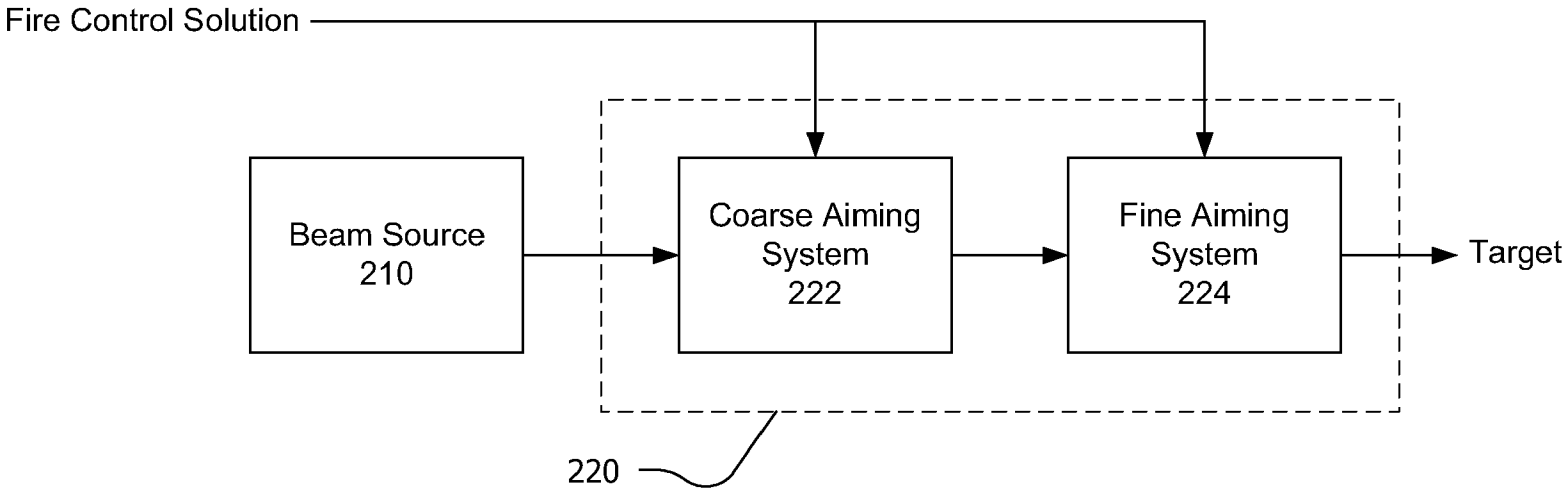
FIG. 2 is a block diagram of an interception system.

The interception system 130 may comprise any appropriate system for generating the beam and controlling the characteristics of the beam, such as aim, spot size, beam intensity, jitter, etc. Referring to FIG. 2, in the present embodiment, the interception system 130 comprises a beam source 210 and a beam controller 220. The beam source 210 generates the beam, such as a laser beam, and the beam controller 220 controls the direction and characteristics of the beam to neutralize the threat, such as through deflagration of the mortar round or other projectile.

For example, the beam source 210 may have sufficient energy such that at least the explosive or other relevant portion of a mortar round or other threat reaches a disruption temperature, at which point the projectile begins to deflagrate. After beginning, the deflagration process may be self-sustaining, thus allowing the interception system 130 to be deactivated or aimed at another projectile once deflagration has begun. The beam controller 220 may also control the beam characteristics, such as intensity, pulse rate, and beam diameter to initiate and sustain deflagration.

The energy levels for deflagration are typically significantly lower than those required to drill through the mortar round casing with a laser. In addition, through deflagration of the threat, the combustion process proceeds through the material relatively slowly, unlike detonation in which the combustion process proceeds through the material at a high rate, in some cases faster than the speed of sound. Detonation is frequently accompanied by a shock wave, resulting in more energy being imparted to the projectile and its shrapnel. During deflagration, less energy is imparted to the projectile and its shrapnel due to the lack of or a significantly reduced shock wave. Deflagration also generally produces less shrapnel overall.

The beam source 210 may comprise any source for generating a beam, such as one or more lasers, particle beams, directed energy weapons, or other directable energy. In the present embodiment, the beam source 210 comprises one or more conventional lasers, such as solid state lasers. The lasers are adapted to generate sufficient energy to heat the threat to the disruption temperature, such as within a selected period of time.

The beam source 210 may comprise any appropriate laser or group of lasers, such as conventional solid state, chemical, or gas lasers. In the present embodiment, the beam source comprises a group of solid state lasers. While such lasers may generate relatively low beam quality, below the deflagration limit, the lower energies required to deflagrate the projectile facilitate the use of relatively compact, lower-power and/or -grade lasers than other systems, such as those that drill through the casing to deactivate the projectile. For example, using a pulsating laser to rapidly drill a hole through the casing of the projectile requires costly high-end lasers. Such lasers are generally not solid state lasers, but chemical or gas lasers and very bulky. The present interception system 130, by heating the projectile to the disruption temperature instead of drilling through it, can utilize a commercial, off-the-shelf, low beam quality solid state laser, which is less costly and less bulky.

In one embodiment, the beam source 210 may comprise a number of solid state industrial fiber lasers, such as 20 to 100 5 kW to 100 kW lasers, such as about 20 kW to about 40 kW lasers, wherein the kW power of the lasers comprises the input power to the beam control system. The laser system is suitably rugged and reliable for field deployment. For example, the beam source 210 may comprise about fifty 20 kW solid state fiber lasers available from IPG Photonics. Although the present embodiment uses a solid state laser, any suitable source may be used to produce the beam, such as one or more gas lasers, chemical lasers, or other system generating a directable beam.

The energy generated by the beam source 210 is provided to the beam controller 220. Any appropriate mechanism and/or technique may be implemented to transfer the energy, such as mirrors, cables, and/or conversion. In the present exemplary embodiment, the energy from the lasers is transmitted to the beam controller 220 via one or more fiber optics, such as a single fiber for delivery of the laser from the beam source 210 to the beam controller 220. In the present embodiment, the solid state, low beam quality lasers allow the flexibility of using fiber optic cable to deliver the beam from the beam source 210 to the beam controller 220. Alternatively, the beam may be delivered to the beam controller 220 using one or more mirrors, or the beam source 210 may be integrated into the beam controller 220. For example, all or a portion of the beam source 210 may be mounted on the Raytheon Phalanx CIWS gun mount such that the beam source 210 moves with the mount while engaging a threat.

The beam controller 220 controls the aiming of the beam to intercept the threat. The beam controller 220 may comprise any suitable system for directing the beam, such as convention optic, electronic, and/or mechanical systems. In the present embodiment, the beam controller 220 is adapted to receive the fire control solution from the tracking system 120 and direct the beam onto the mortar round to cause deflagration. The beam controller 220 may also control various aspects of the beam, such as aim, duration, intensity, diameter, jitter, and/or other characteristics. The beam controller 220 may aim the beam in any appropriate manner, such as in conjunction with conventional mechanical, optical, and/or electronic systems. In the present embodiment, the beam controller 220 includes a coarse aiming system 222 and a fine aiming system 224. The coarse aiming system 222 approximately points the beam at the target and the fine aiming system refines the aim to intercept the target. The beam controller 220 may maintain the beam on the projectile such that the beam maintains contact with the projectile while the projectile is in motion.

The coarse aiming system 222 may comprise any suitable system for approximately aiming the beam at the target. In one embodiment, the coarse aiming system 222 comprises an electromechanical mount capable of rapid azimuth and elevation changes to aim the beam. For example, the coarse aiming system 222 may comprise a weapon mount adapted from a convention Raytheon Phalanx CIWS. In one embodiment, all or a portion of the interception system 130 may be mounted on the movable platform associated with the Phalanx CIWS gun mount system. The Phalanx gun mount system may receive a fire control solution from the tracking system 120 and swivel and elevate accordingly to aim the beam in the proper direction to hit the target.

The fine aiming system 224 may likewise comprise any suitable system for refining the aim of the beam to strike the target. For example, the fine aiming system 224 may comprise electronically driven optics for a laser system to aim the beam at the target and managing the spot size of the beam. In one embodiment, the fine aiming system 224 may be configured to maintain a spot size of the beam that is approximately equal with the width of the target.

The beam controller 220 may also be adapted to control various other aspects of the beam, including jitter and focusing of the beam. Any configuration can be used for controlling the characteristics of the beam, however, whether one system is used for controlling all beam properties or different systems are used for controlling different beam properties. In the present embodiment, the fine aiming system 224 also performs various control functions.

In the present embodiment, the fine aiming system 224 comprises a beam director comprising a diamond-turned metal mirror mounted on a fast steering gimbal. Alternatively, the fine aiming system 224 may comprise a focusing mirror or lens, or combinations of lenses and/or mirrors. The fine aiming system may also comprise a mirror array comprising several smaller mirrors. The smaller mirrors may be static or capable of dynamic focusing. Other fine aiming systems may comprise a single mirror, one or more glass lenses, or other appropriate optical systems. For example, in one embodiment, the fin aiming system 224 may include a stiff beam control system without closed loop control.

Additionally, the beam controller 220 may include a system of one or more lenses or mirrors to control the spot size of the beam on the target, such as a conventional large aperture optics mount. For example, the beam controller 220 may adjust the spot size on the target to promote deflagration of the target. In one embodiment for countering a conventional mortar round, the beam controller 220 may control the spot size such that the spot size remains about the same size as the incoming projectile. Focusing a low quality laser beam so that its spot size is about the same size as the projectile promotes deflagration instead of detonation of the projectile. The beam controller 220 may maintain the beam on the projectile until deflagration. For conventional mortar rounds, deflagration may require about one to five seconds.

Figure 3:
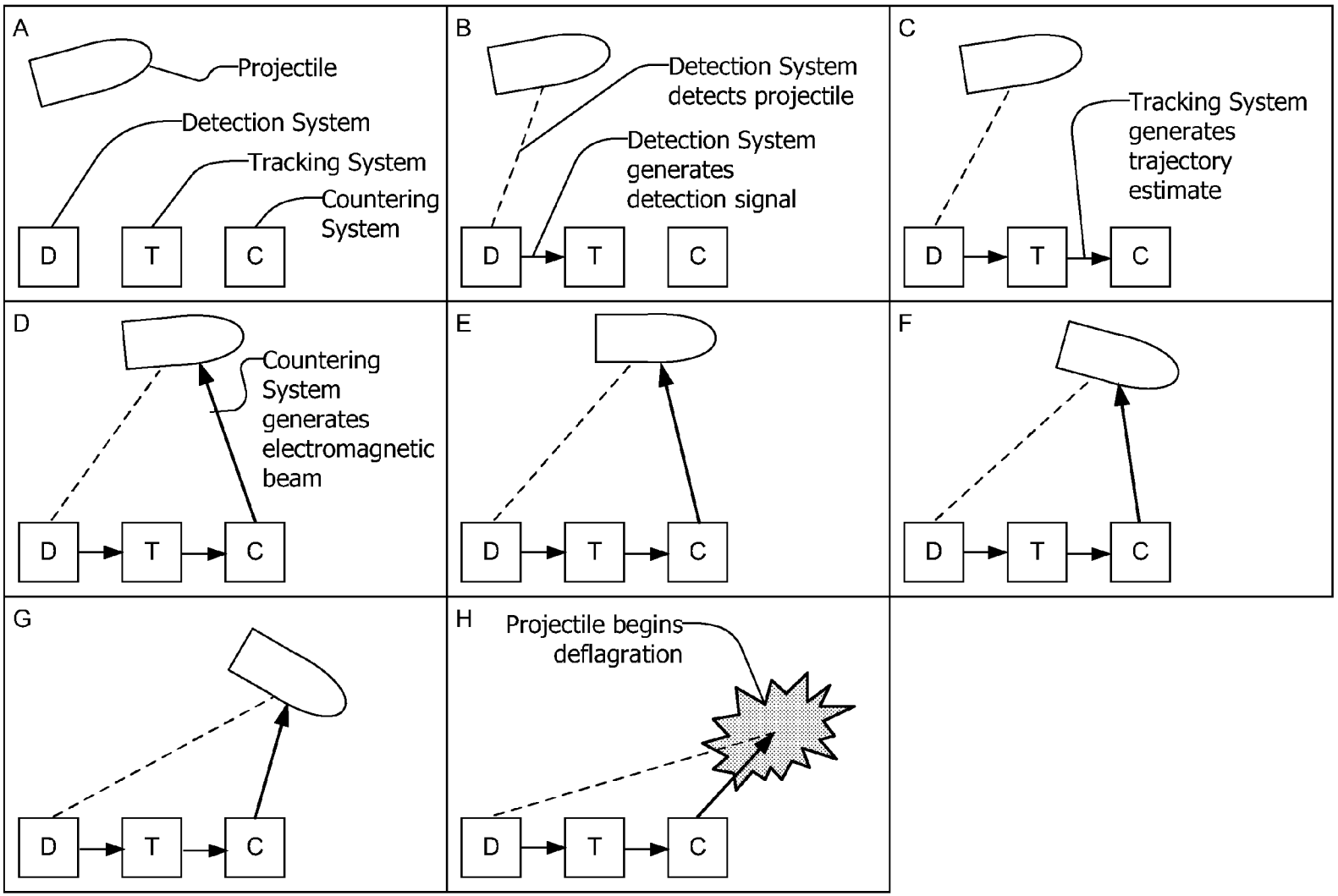
FIG. 3 is a time lapse diagram of a projectile interception.
Figure 4:
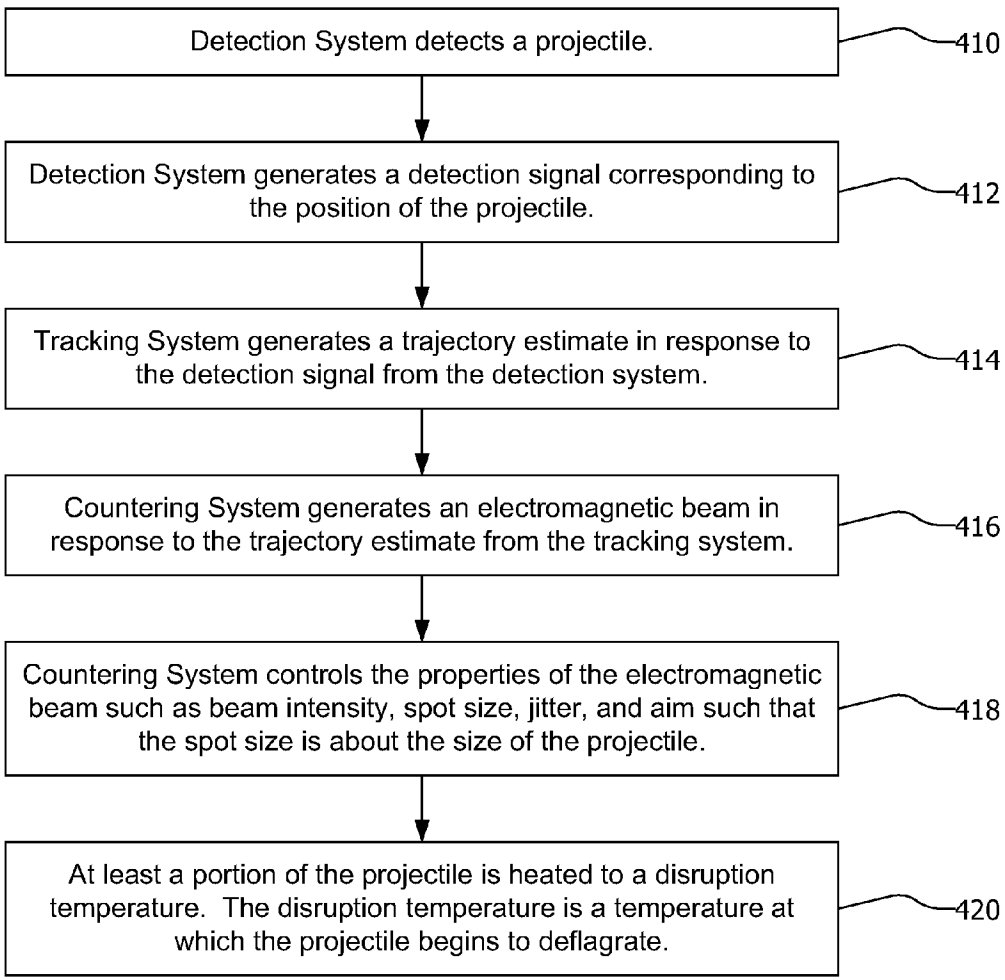
FIG. 4 is a flowchart of a method for countering a projectile.

Referring now to FIGS. 3 and 4, in operation, the detection system 110 detects the threat and provides corresponding signals to the tracking system 120. In the present embodiment, the Phalanx radar system detects the incoming mortar round (410) (FIG. 3A) and generates related target data (FIG. 3B), such as position and attitude (412). The target data is processed by the tracking system 120 to generate the firing solution (414) (FIG. 3C). For example, the tracking system 120 may predict the position of the incoming mortar round at a future time based on position, velocity, elevation, ambient air temperature, interception system 130 characteristics, and any other data that may affect the trajectory of the mortar round and its interception.

The interception system 130 receives the fire control solution and generates a beam of energy to neutralize the threat (416) (FIG. 3D). In the present embodiment, the beam source 210 generates a laser beam of sufficient intensity to cause deflagration of the mortar round. The laser beam is collected from multiple lasers and transmitted via the fiber optic cable to the coarse aiming system 222.

The coarse aiming system 222 receives the fire control solution and points the beam toward the target (418). In the present embodiment, the Phalanx system swivels and points the beam according to the fire control solution to provide coarse aim. The fine aiming system 224 refines the aim of the beam, such as using a beam director comprising mirrors and/or lenses.

The interception system 130 may attack the incoming projectile with the beam such that at least a portion of the projectile is heated to a disruption temperature (420). For example, the interception system 130 may control the spot size on the mortar round and the duration, and intensity of the laser beam to heat the mortar round to a disruption temperature at which the projectile begins to deflagrate. The interception system 130 may alter and/or control the beam properties in any manner appropriate to heat the projectile to the disruption temperature.

The interception system 130 initially strikes the incoming projectile with the beam. The energy to be transferred to the projectile required to deflagrate or otherwise neutralize the projectile, generally corresponding to fluence, may be a function of the beam intensity, the duration of the beam on the projectile, and the area of the projectile exposed to the beam. Power transfer to the projectile and the time and intensity required to deflagrate or otherwise neutralize the projectile may be affected by multiple factors, however, such as jitter, spin rate of the projectile, aspect angle, and atmospheric effects such as wind, dust, and rain. In the present embodiment, the interception system 130 simultaneously maintains aim on the projectile for an appropriate duration, an acceptable level of jitter, and an appropriate beam intensity while maintaining a spot size approximately equal to the projectile size (FIGS. 3D-G). Alternatively, the interception system 130 may adjust the spot size, such as by controlling the diameter of the spot size over the duration of the engagement. For example, the interception system 130 may maintain and/or reduce the spot size to match the dynamics of the engagement.

When the explosive or other selected part of the mortar round reaches the disruption or deflagration temperature, the projectile begins to deflagrate (FIG. 3H). The disruption temperature may vary according to the projectile. For conventional 60 mm and 82 mm mortar rounds, the disruption temperature of the explosive may be about 300° C. Upon deflagration, the mortar round burns without detonation. The interception system 130 may be adapted to deflagrate the projectile while the projectile is still well above the ground to avoid posing a hazard, such as at least 100 meters above ground level.

In the foregoing specification, the invention has been described with reference to specific exemplary embodiments. Various modifications and changes may be made, however, without departing from the scope of the present invention as set forth in the claims. The specification and figures are illustrative, rather than restrictive, and modifications are intended to be included within the scope of the present invention. Accordingly, the scope of the invention should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used in this description, the terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

The invention claimed is:

1. A countermeasure system for countering a projectile according to a fire control solution, comprising:

a beam source adapted to generate an electromagnetic beam; and a beam control system configured to aim the electromagnetic beam at the projectile according to the fire control solution, and to control and maintain a spot size of the electromagnetic beam on the projectile so that the spot size is approximately the same size as the projectile, wherein the electromagnetic beam is configured to heat the projectile until at least a portion of the projectile reaches a disruption temperature to deflagrate the projectile.

2. A countermeasure system according to claim 1, further comprising:

a detection system configured to generate a detection signal corresponding to a position of the projectile; and a tracking system responsive to the detection system and adapted to generate the fire control solution according to the detection signal.

3. A countermeasure system according to claim 1, wherein the bean source comprises a solid state laser.

4. A counter countermeasure system according to claim 3, wherein the solid state laser comprises a plurality of fiber lasers.

5. A countermeasure system according to claim 1, herein the disruption temperature is about 300° C.

6. A countermeasure system according to claim 1, wherein the beam source is configured to maintain the beam on the projectile while the projectile is in motion.

7. A countermeasure system according to claim 1, wherein the beam source is configured to heat the projectile to cause deflagration before the projectile falls below about 100 meters above ground level.

8. An apparatus for countering a projectile, comprising:

a detection system adapted to identify a position of the projectile and generate a corresponding detection signal;

a tracking system responsive to the detection system wherein the tracking system generates a fire control solution in response to the detection signal; and a laser system responsive to the tracking system, wherein:

the laser system generates a laser beam to intercept the projectile according to the fire control solution, the laser system controls and maintains a spot size of the laser beam on the projectile so that the spot size is approximately the same size as the projectile, and the laser bear heats the projectile until at least a portion of the projectile reaches a disruption temperature to deflagrate the projectile.

9. An apparatus according to claim 8, wherein the laser system comprises a solid state laser.

10. An apparatus according to claim 9, wherein the solid state laser comprises a plurality of fiber lasers.

11. An apparatus according to claim 8, wherein the disruption temperature is about 300° C.

12. An apparatus according to claim 8, wherein the laser system is configured to maintain the beam on the projectile while the projectile is in motion.

13. An apparatus according to claim 8, wherein the laser system is configured to heat the projectile to cause deflagration before the projectile falls below about 100 meters above ground level.

14. A method for countering a projectile, comprising:

detecting the projectile;

generating a fire control solution for intercepting the projectile;

intercepting the projectile with an electromagnetic beam according to the fire control solution;

controlling and maintaining a spot size of the electromagnetic beam on the projectile so that the spot size is approximately the same size as the projectile; and heating the projectile with the electromagnetic beam until at least a portion of the projectile reaches to a disruption temperature to deflagrate the projectile.

15. A method for countering a projectile according to claim 14, wherein the beam is generated by a solid state laser.

16. A method for countering a projectile according to claim 15, wherein the solid state laser comprises a plurality of fiber lasers.

17. A method for countering a projectile according to claim 14, wherein the disruption temperature is about 300° C.

18. A method for countering a projectile according to claim 14, further comprising maintaining the beam on the projectile while the projectile is in motion.

19. A method for countering a projectile according to claim 14, wherein heating at the projectile comprises heating at least a portion of the projectile to the disruption temperature before the projectile falls bellow about 100 meters above ground level.

* * * * *

UNITED STATES PATENT AND TRADEMARK OFFICE

CERTIFICATE OF CORRECTION

PATENT NO. : 7,946,207 B1
APPLICATION NO. : 12/138955
DATED : May 24, 2011
INVENTOR(S) : Porter et al.

It is certified that error appears in the above-identified patent and that said Letters Patent is hereby corrected as shown below:

Column 7, line 50: replace --bean-- with “beam”

Column 7, line 51: remove “counter”

Column 7, line 54: replace --herein-- with “wherein”

Column 8, line 17: replace --bear-- with “beam”

Column 8, line 56: replace --bellow-- with “below”

Signed and Sealed this
Twenty-third Day of August, 2011

David J. Kappos

David J. Kappos
*Director of the United States Patent and Trademark Office*